United States Patent [19]

Cardoza, Jr. et al.

[11] Patent Number: 5,018,746

[45] Date of Patent: May 28, 1991

[54] FIELD GAME APPARATUS AND METHOD

[75] Inventors: Joseph W. Cardoza, Jr., Acton, Calif.; Randolph P. Glass, 516 Calle Baranda, San Clemente, Calif. 92672

[73] Assignee: Randolph P. Glass, San Clemente, Calif.

[21] Appl. No.: 475,781

[22] Filed: Feb. 6, 1990

[51] Int. Cl.[5] ..... A63B 7/02; A63B 59/02; A63B 43/00

[52] U.S. Cl. ..... 273/411; 273/58 F; 273/67 R; 273/326; 273/415

[58] Field of Search ..... 273/323, 325, 326, 348, 273/324, 411, 415, 428, 67 R, 73 R, 76, 129 R, 129 K, 58 R, 58 A, 58 F, 58 K

[56] References Cited

U.S. PATENT DOCUMENTS

| | | | |
|---|---|---|---|
| 2,078,382 | 4/1937 | Hanshaw | 273/58 K |
| 2,086,094 | 7/1937 | Reach | 273/58 A |
| 3,108,807 | 10/1963 | Ruehle | 273/325 |
| 3,508,611 | 3/1970 | McPherson | 273/73 R X |
| 3,518,786 | 7/1970 | Holtvoigt | 273/58 A X |
| 3,674,266 | 7/1972 | Grosberg | 273/73 R |
| 3,711,095 | 1/1973 | Todd | 273/348 |
| 3,968,968 | 7/1976 | Peterson | 273/411 |
| 4,354,679 | 10/1982 | Steinmetz | 273/58 A |
| 4,357,019 | 11/1982 | Wouters | 273/411 |
| 4,368,890 | 1/1983 | Horstman et al. | 273/76 X |

*Primary Examiner*—William H. Grieb
*Attorney, Agent, or Firm*—James E. Hawes

[57] ABSTRACT

The disclosed field game employs a soft, non-resilient ball not retaining a definite shape which is caught, manipulated and flung back and forth over a self-supporting scoring obstacle by players each using a racquet consisting of a flexible staff with a containing network at each end to catch, manipulate and fliong the ball.

10 Claims, 3 Drawing Sheets

FIELD GAME APPARATUS AND METHOD

FIELD OF THE INVENTION

The present invention relates to a method and apparatus for playing an athletic game; the game involves two or more players, each using a racquet, catching and throwing a ball back and forth over a net.

BACKGROUND OF THE INVENTION

Many athletic games are played using a ball, racquet and net. Some, like tennis and badminton, employ the net to divide the playing field into opposed areas. Others, like lacrosse, use the net to define the goal.

Each of these basic game elements—the ball, racquet and net—presents significant challenges to the game designer, and can result in significant problems for the game player. For example, the typical ball, being round and relatively hard, readily rolls and will continue to roll until stopped. In some games, this is desirable; in others it is not. It can present a real problem for elderly players. As another example, the racquet that is used in athletic games typically is held by the player in one hand, and is swung to contact the ball. This imparts a significant stress and torque to the player's arm, and can lead to injury or impairment of the player's arm and joints. Moreover, when a racquet is held in one hand, it does not encourage an even development in the player's coordination and dexterity, but instead favors one hand over the other. Typical nets are staked or otherwise permanently fixed to the playing field, and limit the field's use for other games. Also, because they are fixed they can injure a player who collides with a net or its supporting structure.

Among the objects of the present invention is to provide an apparatus and method for an athletic game that encourages dexterity and coordination of the players, employs a net that need not be permanently affixed to the field but may be erected at any suitable location, indoors or outside, and which uses a soft, non-resilient ball that does not readily roll or retain a definite shape, but tends to remain where it drops, thus permitting the game to also be played by older people.

Brief Summary of the Invention:

The invention concerns an athletic game for two or more people that is played by volleying a ball over a scoring obstacle within a defined area using a double-ended racquet.

Preferably the ball is relatively soft, non-resilient and is designed to inhibit its tendency to roll.

Preferably the scoring obstacle is a free-standing, portable and easily erected structure.

Preferably the racquet is a staff with a preformed containing network at each end, the containing network being designed to catch and hold the ball, and to permit it to be thrown by the player.

The method of the preferred athletic game of the present invention contemplates players using the aforementioned equipment, throwing the ball back and forth over the scoring obstacle, each player catching the ball in one of the containing networks at the end of the staff then throwing the ball up in the air such that it may be caught again by the player in one of the containing network on the player's staff, or thrown to pass over the scoring obstacle to be caught if possible by the other player. A point is awarded to a player when the opponent misses or drops the ball.

Brief Description of the Drawings:

The invention will be further described in connection with the accompanying drawings in which.

DETAILED DESCRIPTION

Figure 1:
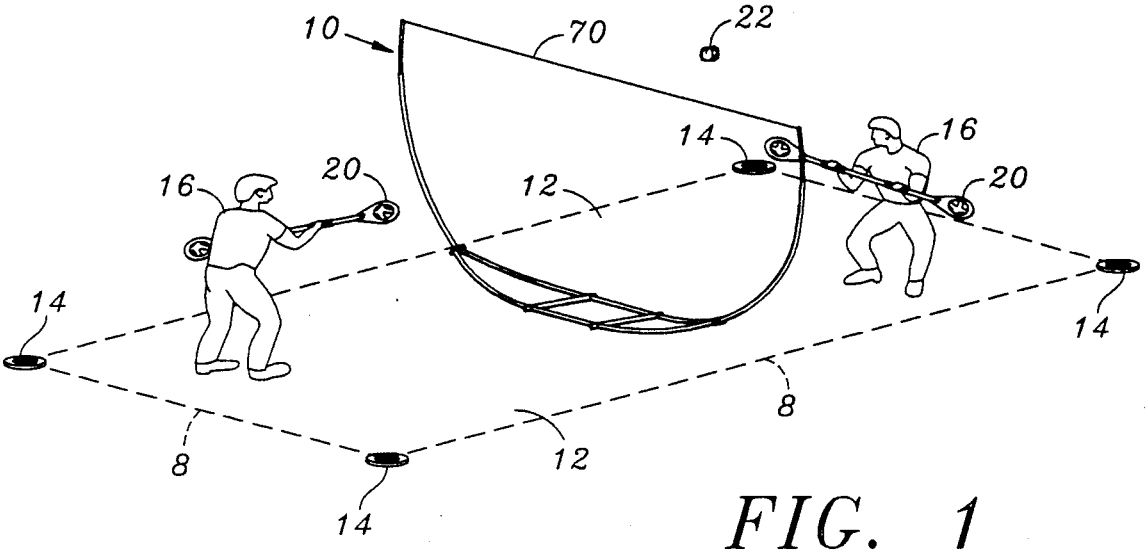
FIG. 1 is an overall perspective view of a field game being played using the preferred apparatus of the present invention.

The athletic game apparatus of the present invention includes a ball, a scoring obstacle, and a racquet for each of the players. The game is played, as illustrated in FIG. 1, within an area defined by boundaries 8 and divided by a scoring obstacle 10 into two equal and opposed playing areas 12. The playing areas may each be about two racquet lengths wide and three racquet lengths long. The boundaries are defined by four visibly distinctive markers 14; the boundary lines are imagined by the players to be the straight lines (shown as dashed lines in FIG. 1) connecting the markers.

As shown in FIG. 1, the game may be played by two players 16. There is, however, no limit to the number of players. If more players are present, the boundaried area should be enlarged accordingly.

The game employs a racquet 20 which is used by each player to catch a ball 22 and throw it over the scoring obstacle 10. The racquet 20 has an annular structure 24 at each end for catching the ball. In playing the game, the player swings the racquet to fling the ball 22 from one containing network 24 either up in the air to be caught by the other containing network on his own racquet, or to propel the ball over the scoring obstacle into the opponent's area. The other player then, if he (or she) can, catches the ball in one of the containing networks on the racquet. He may then juggle the ball back and forth between the containing networks on his racquet until he decides to throw the ball over the scoring obstacle. Play continues until the ball hits the ground and a point is awarded. The game ends when a player attains an agreed number of points. Of course, variations in this method of playing a field game with the preferred apparatus, and various embellishments, may be used if desired.

The Ball

Figure 2:
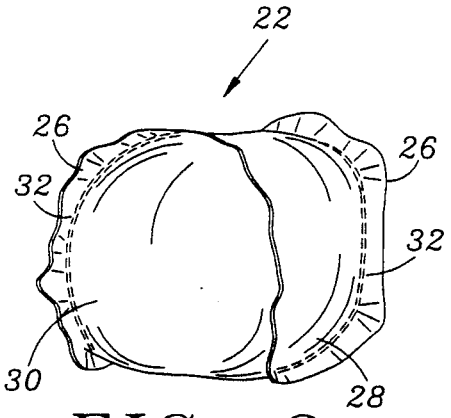
FIG. 2 is an enlarged perspective view of a preferred embodiment of the ball.

The presently preferred ball 22 is shown in FIG. 2. Any type of ball with proper dimensions to be caught in the racquet may be used to play the game. Preferably, the ball 22 is designed for self absorption of its own inertial mass upon contact with the racquet's annular structure 24; and thus, the ball will not retain a definite shape. To accomplish this, the inside of the ball is loosely stuffed with small pellets, such as of plastic or STYROFOAM, each with space to move somewhat within the outer covering of the ball much like the beams in a blanking. This construction also ensures that the ball is soft and will not bounce or roll much when it is caught, or falls into the playing field. Also, being made in this manner it is less likely to do damage or harm should it strike another object. It is therefore less likely to encroach on the territories of other outdoor enthusiasts while they pursue their activities.

The outer covering of the ball 22 can be made of any flexible sheet material such as cloth or vinyl. In the presently preferred embodiment it is made of CORDURA, which is easily washed and very durable. Also, CORDURA is reputed to be far more abrasive resistant than canvas.

The ball is designed to inhibit its ability to roll. This is accomplished by forming the ball in a shape other than spherical, and by extending flanges 26 from the ball (see FIG. 2). Preferably, the ball should be somewhat cubed in shape, with an approximate circumference of 12 inches, and should have flanges extending from its exterior edges sufficiently to diminish the tendency for the ball to roll. Such a ball may be constructed from two identically shaped pieces of CORDURA. The two pieces are substantially rectangular in shape and are approximately four inches by nine inches. As shown in FIG. 2, the CORDURA pieces 28 and 30 are not exactly rectangular in that each of the four corners are slightly curved. The curvature at each corner allows the two pieces to be folded together into a somewhat cubical shape with approximately ¼" flanges 26 projecting from the ball.

To make such a ball, the two pieces of CORDURA are positioned such that a four inch edge of the first piece is in contact with the middle four inches of one of the nine inch edge of the second piece, and the other four inch edge of the first piece is folded over to contact the middle four inches of the other nine inch edge of the second piece. In this position, the four inch edges of the second piece are similarly made to contact the nine inch edges of the first piece. The pieces are then sewn together with stitches 32 tracing a path approximately ¼" from the edges. At some point prior to the two pieces being completely sewn together, a sufficient number of suitable pellets are inserted into the ball to fill it out into its generally cubical shape.

The Racquet

Figure 3:
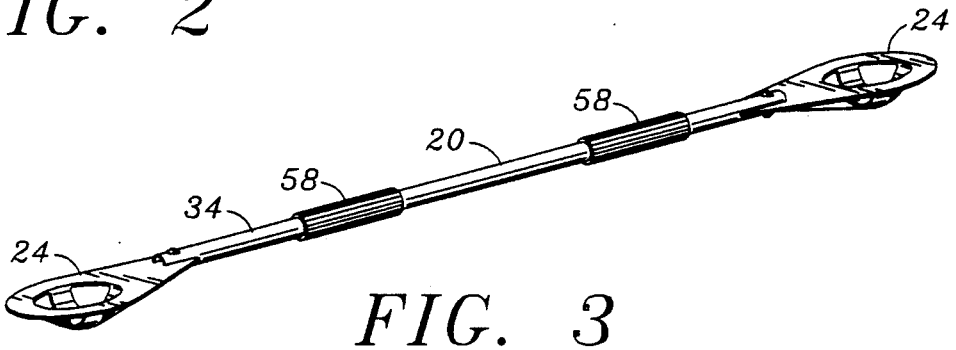
FIG. 3 is a perspective view of a preferred embodiment of the racquet.

The racquet 20 is shown in FIG. 3. It consists of a staff 34, annular structures 24, one at each end of the staff, and two hand grips 36.

The racquet 20 is specifically designed to encourage a player's balanced development or coordination of physiological responses in a natural and comfortable fashion. By virtue of its design, the racquet does not favor either the left or right sides of the player's brain or body, as do such sports as tennis, golf, baseball and lacrosse for example.

In the presently preferred embodiment, the staff 34 is a flexible cylindrical member made in one or two lengths. A 4'9½" long staff 34 may be used to play an adult version of the game and a 3'7 ½" long staff is used by children to play the game. In either case, the presently preferred staff 34 has a diameter of approximately 0.875" and is made of polycarbonate pipe. Polycarbonate is a flexible or supple plastic material with the ability to bend and return to its original shape instantly. The initial shock of making contact with the ball is for the most part absorbed by the staff 34 along its length. This design thereby significantly reduces the chance of strain or damage to the player's muscle, joints, bones and tissue, as opposed to the rigid apparatus involved in other sports. For this reason, the muscles of the players of the present game tend to develop evenly and at a steady pace.

Figure 4:
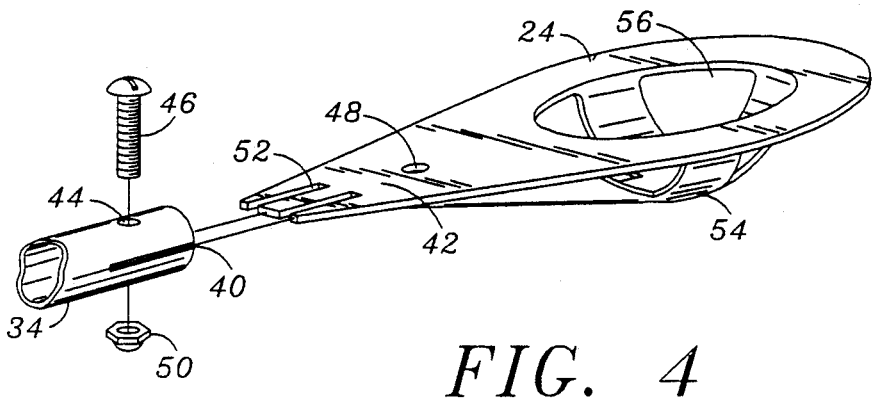
FIG. 4 is an enlarged, exploded perspective view of one end of the preferred racquet showing various components of the racquet prior to their assembly.

Each end of the staff 34 has attached thereto an annular structure 24. As shown in FIG. 4, in the preferred embodiment the staff at each end includes a slot 40 into which flange 42 on the annular structure 24 is inserted. A hole 44, for receiving a bolt 46, is provided in the end of the staff. The annular structure also includes a hole 48 for receiving the bolt 46. When the holes 44 and 48 are aligned, bolt 46 is passed through them and the structure is clamped together by tightening a nut 50 on the bolt. Preferably a rectangular opening, 52 is provided at the edge of the flange to allow the annular structure be inserted deeply into slot 40 to create a secure attachment and also to give a sleek, streamlined appearance to the racquet 20.

In the presently preferred embodiment, the annular structures 24 are aligned such that the top surfaces of both structures lie in the same plane.

The annular structures 24 may be made of polypropylene injection molded into the shape shown in FIG. 4. The top surface of the annular structure 24 defines a plane beneath which an integrally formed bowl-shaped containing network 54 extends. The rim portion of the containing network 54 is integrally formed with the top planar surface of the annular structure (as shown in FIG. 4).

Each containing network 54 has four large triangular shaped openings 56 to automatically shed any foreign debris that might be inadvertently picked up and thrown during play. These openings also make the containing network structure lighter and permit the racquet to be easily swung through the air. The rounded shape of the annular structure reduces the possibility of injury upon accidental contact of the racquet's annular structure with oneself or other players.

The containing network 54 is, of course, sufficiently sized and shaped to catch and hold the ball 22. The size of each opening 56 is smaller than the ball to ensure that the ball is retained within the containing network.

In the presently preferred embodiment, the racquet includes two hand grips 58, each being cylindrical and made of foam rubber, with a length of approximately eight inches. The cylindrical hand grips are received on and may be slid along the staff 34 by the player to a position where the staff can be gripped comfortably by both hands, each hand resting on one of the hand grips.

The hand grips 58 add comfort and a non-slip surface on which to grasp and hold the staff; they also further absorb any shock resulting from catching and flinging the ball 22.

The Scoring Obstacle

Figure 5D:
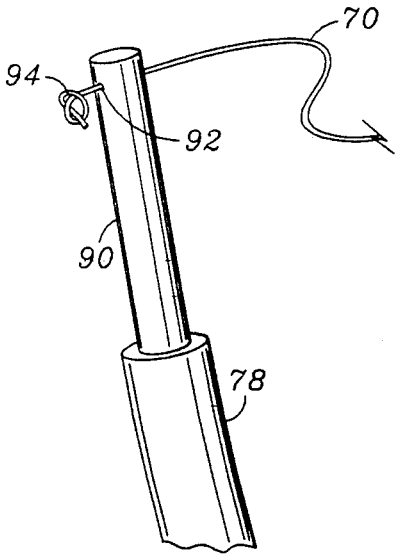
FIG. 5*d* is an enlarged, exploded view of the assembled parts of the scoring obstacle within the circle labeled as 5*d* in FIG. 5*a*and FIG. 5*e* is a plan view showing the components of the scoring obstacle disassembled.

The presently preferred scoring obstacle used to play the field game could be any structure which divides the playing area in half. In the preferred embodiment, as shown in FIGS. 1 and 5*a*, the scoring obstacle contains simply a single cord 70, which has proven to be a practical solution to the obvious drawbacks of a larger and more complete net structure and supporting apparatus. This game requires only a visible cord, at any given height, over which to play. The preferred cord 70 is a bright orange and is adjustable to different heights. Also, it has less wind resistance and can be supported by a unique framework, one which requires no heavy weights, no stakes to be driven into the ground, and no dangerous guy wires.

The cord preferably is supported by a structure that is fully portable, that is light and compact and can be taken anywhere, and that can be set up and disassembled in seconds on virtually any surface. The scoring obstacle 10 is lightweight and can be picked up and moved as a unit while still in the upright playing mode. When disassembled, it can be easily carried along with all the combined apparatus that makes up the game, by one person, with one hand, comfortably. Also, it can be adjusted instantly with no need for any tools.

The scoring obstacle is free-standing, and supports the cord 70 approximately 7 feet over a foundation such as on the ground, on a concrete pad, or indoors on a floor. In a presently preferred embodiment, the base is made from twelve pieces of extruded polycarbonate tubing. It consists of two midsection pieces 72 of tubing which form part of the pair of the scoring obstacle's longitudinal rails; the midsection has a length of approximately 36 inches. Two crossbar pieces 74 extend between the longitudinal rails and are of approximately 29 inches long. Four end pieces 76 conclude the longitudinal rails; they are each approximately 59 inches long. Two side pole pieces 78 are each about 59 inches long and are supported by the longitudinal rail assembly.

Figure 5E:
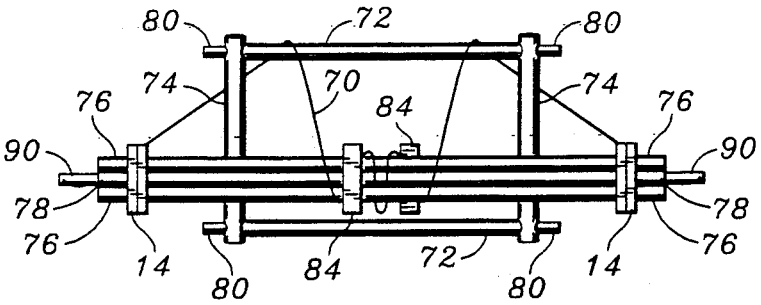
FIG. 5*a* is a perspective view of a preferred embodiment of the scoring obstacle.
FIG. 5*b* is an enlarged, exploded view of the assembled parts of the scoring obstacle within the circle labeled as 5*b* in FIG. 5*a;*
FIG. 5*c* is an enlarged, exploded view of the assembled parts of the scoring obstacle within the circle labeled as 5*c* in FIG. 5*a;*
Figure 5A:
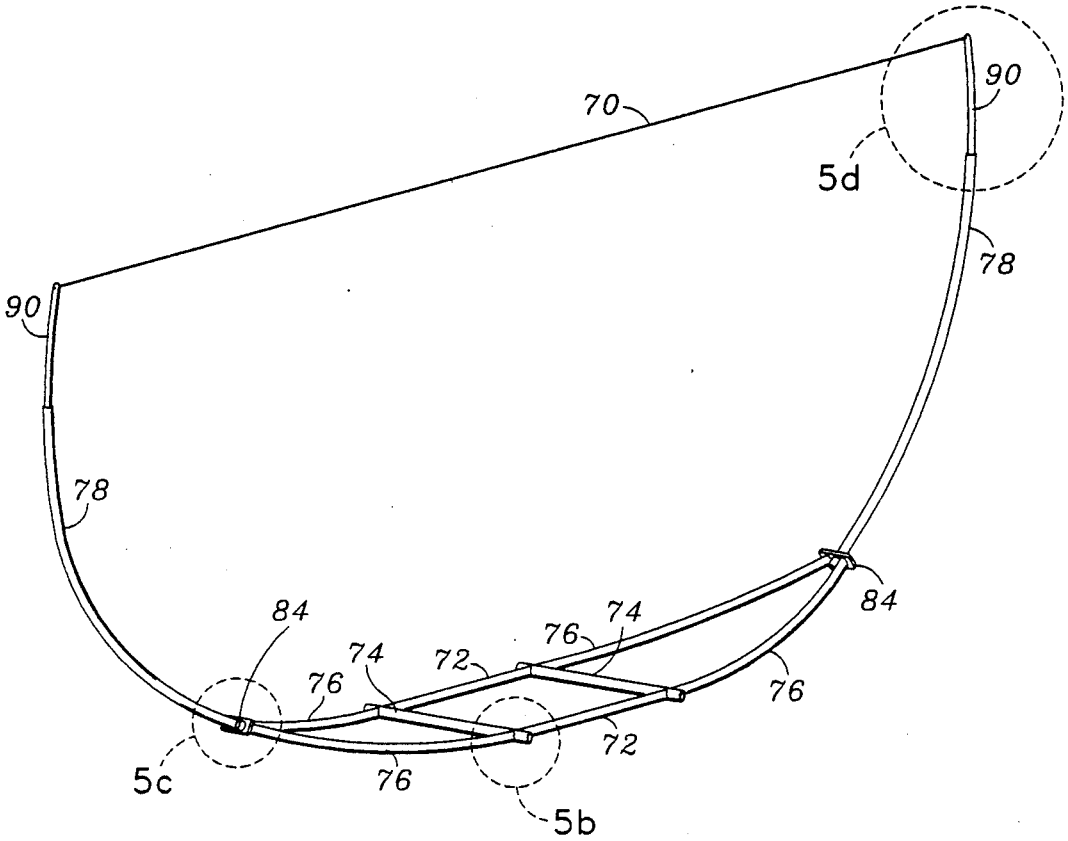
Figure 5B:
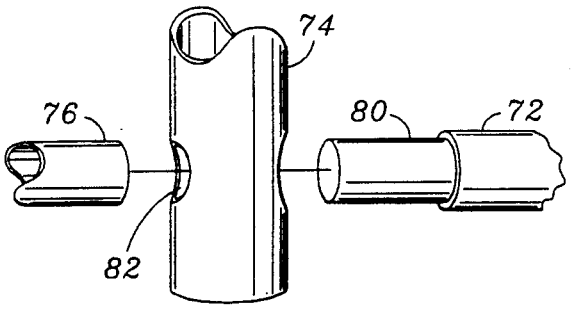

To assembly the longitudinal rails, as shown in FIG. 5*b*, each of four approximately 5" long dowels 80 is inserted approximately 2" into the hollow ends of the two midsection pieces 72. Each dowel 80 may be held in this position with poly cement. The crossbar pieces 74 each have a hole 82 drilled near each end, as shown in FIG. 5*b*. The axial line of both holes lines perpendicular to the axial line of the tubing, and are parallel to each other. Thus, to assemble the base structure the dowels 80 are passed through openings 82 in crossbar 74 and inserted into the end pieces 76.

Figure 5C:
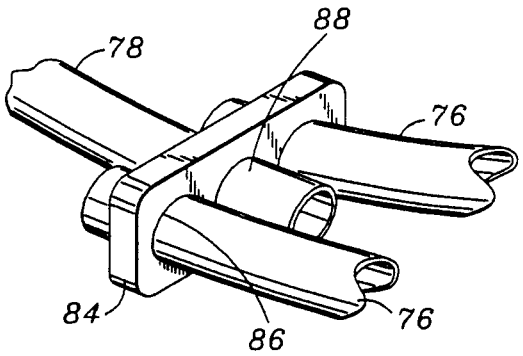

A connector piece 84 (shown in FIG. 5*c*) has two side holes 86 for closely receiving the ends of the end pieces 76 and a center hole 88 for closely receiving the end of a side pole 78. The axial lines of the side holes 86 are parallel to one another, and offset from the axial line of the center hole 88.

The outer ends of the side poles 78 each receive an end of a cylindrical member 90, which may also be a tubular section of polycarbonate. It is best shown in FIG. 5*d*, the other end of the cylindrical member 90 having a hole 92 through which an end of the cord 70 passes, and is then tied in a knot 94 to prevent the cord from slipping back through hole 92. Cylindrical members 90 preferably are orange to better define the side boundaries, and may be each about 36 inches long. The cords end may be a more significant line, preferably brightly colored, approximately 0.105" in diameter.

To set up the scoring obstacle 10, the midsections 72 and crossbar sections 74 are first placed into a rectangular position with the extending 3" of dowel 80 for each end of the midsections 72 being inserted through a respectively hole 82 at the end of a crossbar 74. Next, one end of each of the four end sections 76 is slid over each of the extending portions of dowel 80 exposed beyond the crossbar 74. Then each unconnected end of the end sections 76 is inserted into one of the side holes 86 on the connector piece 84. The ends of side poles 78 are placed in the connector piece. One end of a member 90 then is slipped into an outer end of a side pole, and the side pole pulled up as the assembler walks along the assembled base structure, gradually forming it into a bow. When the assembler reaches the other side pole, the face end of member 90 at the other end of the cord is slipped into the side pole, and the structure allowed to tip upright into the form and orientation shown in FIG. 1 or 5*a*. The assembly may be adjusted, for example, by sliding members 90 further into, or out of, end poles 78, thereby raising or lowering the cord.

When assembled, the presently preferred cord 70 measures approximately 13'0", being of sufficient length for the knots 94 at each end to be received in the holes 92 in both cylindrical members 90. All joints and connections of the scoring obstacle are maintained solely by tension and friction (except for the dowels 8 which are held by cement in the midsections).

The scoring obstacle may be partially disassembled, as shown in FIG. 5*e*, for carrying or storage. Preferably markers 14 are rings which snugly receive the ends of the end sections and hold them together, as shown. It is therefore easily carried, transported and stored.

Various modifications and alterations will be apparent to, and may be preferred by, others having ordinary skill in this art. Therefore, the illustrated embodiment of the field game apparatus has been set forth only as a presently preferred example of the invention, and should not be construed as limiting the invention defined by the following claims.

We claim:

1. A field game apparatus comprising:

a soft, non-resilient ball not retaining a definite shape, said ball comprising an outer covering and a plurality of pellets contained within said outer covering which pellets are free to move within said outer covering;

a scoring obstacle comprising a support structure and a cord, said cord being supported by said supporting structure in an elevated location relative to a playing surface; and a plurality of racquets each racquet comprising a supple staff and two substantially identical annular structures each at an opposite end of said staff each said annular structure comprising a flange, an annular portion, and a containing network, whereby players may each manipulate a racquet to catch said ball in the first of said containing networks and further manipulate said staff and ball by flinging said ball from the first of said containing networks to the second of said containing networks or over said scoring obstacle as desired.

2. A field game apparatus as set forth in claim 1 wherein said ball includes means to impede it from readily rolling.

3. A field game apparatus as set forth in claim 2 wherein said ball is non-spherical.

4. A field game apparatus as set forth in claim 2 wherein said ball has projecting flanges to impede the rolling of said ball.

5. A field game apparatus as set forth in claim 1 wherein said scoring obstacle is a self-tensioning unitary structure that is freestanding and portable with respect to the playing surface and that is assembled in a bow shape.

6. A field game apparatus as set forth in claim 5 wherein said unitary structure is in sections that may be manually assembled and disassembled.

7. A field game apparatus as set forth in claim 5 in which said scoring obstacle is adjustable to adjust the height at which the cord is supported above the playing surface.

8. A field game apparatus as set forth in claim 1 wherein each said containing network has orifices large enough to expel sand and foreign debris but small enough to hold said ball.

9. A field game apparatus as set forth in claim 1 wherein said ball contains pellets of plastic or "STYROFOAM".

10. A field game apparatus comprising:

a generally cubic ball having flanges extending along its edges;

a visibly distinct net cord;

a free-standing, portable support structure connected to both ends of said cord for supporting said cord at an elevated location generally parallel to a foundation; and a plurality of racquets, each racquet comprising a flexible staff; a first cup fixed to the first end of said staff; and a second cup fixed to the second end of said staff; each of said cups being shaped to retain said ball within said cup, whereby a player can manipulate said racquet to catch said ball within said first cup and further manipulate said staff to eject said ball from said first cup and propel said ball into said second cup or over said net cord.

* * * * *